United States Patent [19]

Kueenzle et al.

[11] 4,417,112

[45] Nov. 22, 1983

[54] LOAD BREAK SWITCH WITH CURRENT QUENCHING DEVICE

[75] Inventors: Paul Kueenzle; Juergen Krysiak; Hans-Karl Reuter, all of Berlin, Fed. Rep. of Germany

[73] Assignee: Siemens Aktiengesellschaft, Fed. Rep. of Germany

[21] Appl. No.: 358,275

[22] Filed: Mar. 15, 1982

[30] Foreign Application Priority Data

Mar. 20, 1981 [DE] Fed. Rep. of Germany ..... 3111793

[51] Int. Cl.[3] ..... H01H 33/12

[52] U.S. Cl. ..... 200/146 R; 200/48 R

[58] Field of Search ..... 200/146 R, 148 R, 48 R

[56] References Cited

U.S. PATENT DOCUMENTS 2,572,625 10/1951 Johnson ..... 200/146 R
2,658,977 11/1953 Hoye ..... 200/146 R
4,031,346 6/1977 Bridges ..... 200/146 R

FOREIGN PATENT DOCUMENTS 3025485 1/1982 Fed. Rep. of Germany .
813697 6/1937 France .

*Primary Examiner*—Robert S. Macon
*Attorney, Agent, or Firm*—Karl F. Milde, Jr.; Andrew G. Rodau

[57] ABSTRACT

The pivotal switching arm of a "swivel post" type load break switch carries, in addition to a blade contact, a U-shaped sliding block type conducting driver which has an elongated elastically expandable slot that engages the ratchet head of the rectilinearly movable switch pin of a current quenching device mounted on the fixed contact post. To control the spring constant of the slot, an enlarged opening is provided at one end of the slot which reduces the cross-section of the driver. At the other end of the slot, an enlargement serves to release the ratchet head when the switch opens. The driver enables rectilinear quenching devices to be used in conjunction with the curvilinear motion of the switching arm.

5 Claims, 4 Drawing Figures

LOAD BREAK SWITCH WITH CURRENT QUENCHING DEVICE

BACKGROUND OF THE INVENTION

1. Field of the Invention

This invention relates to medium voltage range load break switches, and especially to such switches of the "swivel post" type.

2. Description of the Prior Art

Examples of prior art "swivel post" type load break switches are described in German Auslegeschrift DE-AS No. 2,711,342 and French Pat. No. 813,635. Such break switches have first and second current lead terminals mounted atop separate fixed, generally vertical insulator posts. A contact connected by means of a flexible conductor to one of the current lead terminals is mounted atop a third insulator post positioned between the insulator posts which carry the first and second current lead terminals. The third insulator post is pivotable about its lower end between a position wherein the carried contact establishes connection between the current lead terminals and a position wherein the contact does not establish connection between the current lead terminals.

In conformity with the arcuate path traversed by the movable contact during opening and closing of the switch, conventional current quenching means are designed to have a curvilinear form. Furthermore, in conventional quenching means setups, a part of the components making up the quenching means is located on the switching arm, while another part is installed at the fixed insulator post which carries the fixed contact lead terminal toward which the movable contact moves on switch closing.

Conventional longitudinal moving quenching means are known for break switches which have recriprocating switch arms. An example of such means is disclosed in German Offenlegungsschrift DE-OS No. 2,907,574. Such quenching system types are designed as cohering units, as distinguished from divided quenchers according to German Patent Publications DE-PS No. 946,638 or DE-AS No. 2,711,342. Longitudinally moving quenching means have not been used with "swivel post" switches because of the arcuate path traveled by the switching arm in the swivel post devices.

SUMMARY OF THE INVENTION

It is an object of the present invention to provide an improved "swivel post" load break switch which makes possible the use of conventional longitudinally moving quenching means to quench the current during the arcuate movement of the switching arm of the circuit breaker.

In accordance with one aspect of the invention, a break switch of the "swivel post" type is provided in which a quenching means is arranged as a unit, fixed, close to the stationary contact piece and which comprises as its current-supplying and actuating element a switch pin guided for reciprocal displacement and having a ratchet head at its outer end. The switching arm carries a sliding block type driver which is coupled or uncoupled from the ratchet head of the quenching means as a function of the angular position of the switching arm. The driver is designed so that the ratchet head can move in the driver during the swivel movement in such a manner that the switch pin can freely execute a rectilinear movement. In a preferred embodiment of the invention, discussed in greater detail below, the driver has an elastically expandable slot for passage of the ratchet head and, near the end corresponding to the open position of the switch, an expansion for passage of the ratchet head. Due to the elastic expandability of the driver, the latter is pushed over the ratchet head when the switching arm reaches the closing position. The position of the expansion in the slot makes it possible to bring about the release of the switch pin in an accurately predetermined way in accordance with the angular position of the switching arm.

In accordance with a further aspect of the invention, for the coupling of the driver with the ratchet head on closing, a certain elasticity and flexibility of the driver against expansion is desired. This is achievable to a certain degree, as described below with reference to illustrative embodiments, regardless of the external dimensions of the driver and the material thereof, by the size and shape of an opening provided at the end of the slot opposite the expansion. This opening reduces the driver cross-section and can be sized to produce a desired spring constant.

For the coupling of the driver with the ratchet head, it is further desirable to border the slot by inclined flanks. This produces a funnel effect which guides the ratchet head to the center of the slot as it strikes the driver, and also creates a lever effect for expansion of the slot.

The driver serves for both mechanical coupling with the switch pin and for current transmission during load cut-off. The passage of current can be improved by modifying the driver to include at least one spring contact element, arranged on the side of the driver toward the switch pin of the quenching means and approximately parallel to the slot.

There have thus been outlined rather broadly certain objects, features and advantages of the invention in order that the detailed description that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the purposes of this invention. It is important, therefore, that this disclosure be regarded as including all such equivalent arrangements that encompass the spirit and scope of the invention.

BRIEF DESCRIPTION OF THE DRAWINGS

Embodiments of the invention have been chosen for purposes of illustration and description, and are shown in the accompanying drawings forming a part of the specification, wherein.

Throughout the drawings, like elements are referred to by like numerals.

DESCRIPTION OF THE PREFERRED EMBODIMENTS

Figure 1:
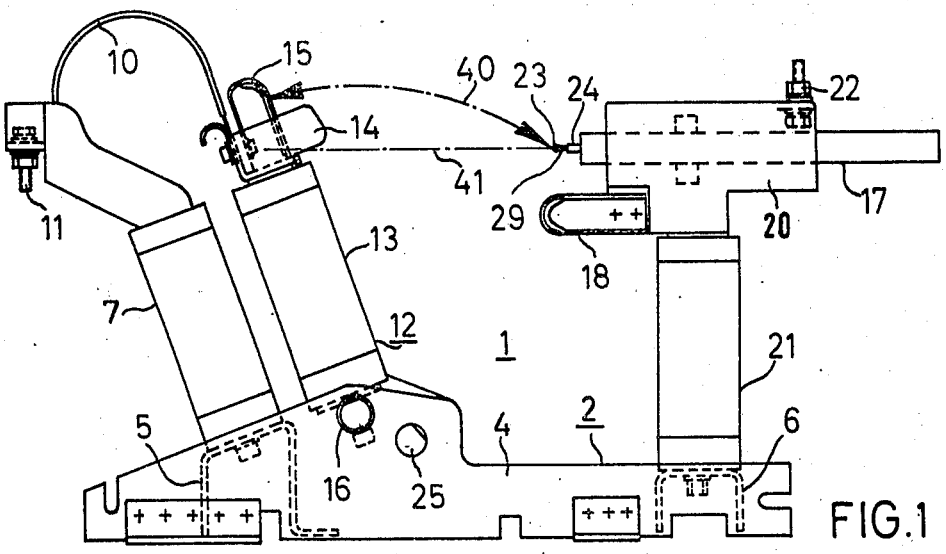
FIG. 1 is a side elevation view of an embodiment of a load break switch in accordance with the invention.
Figure 2:
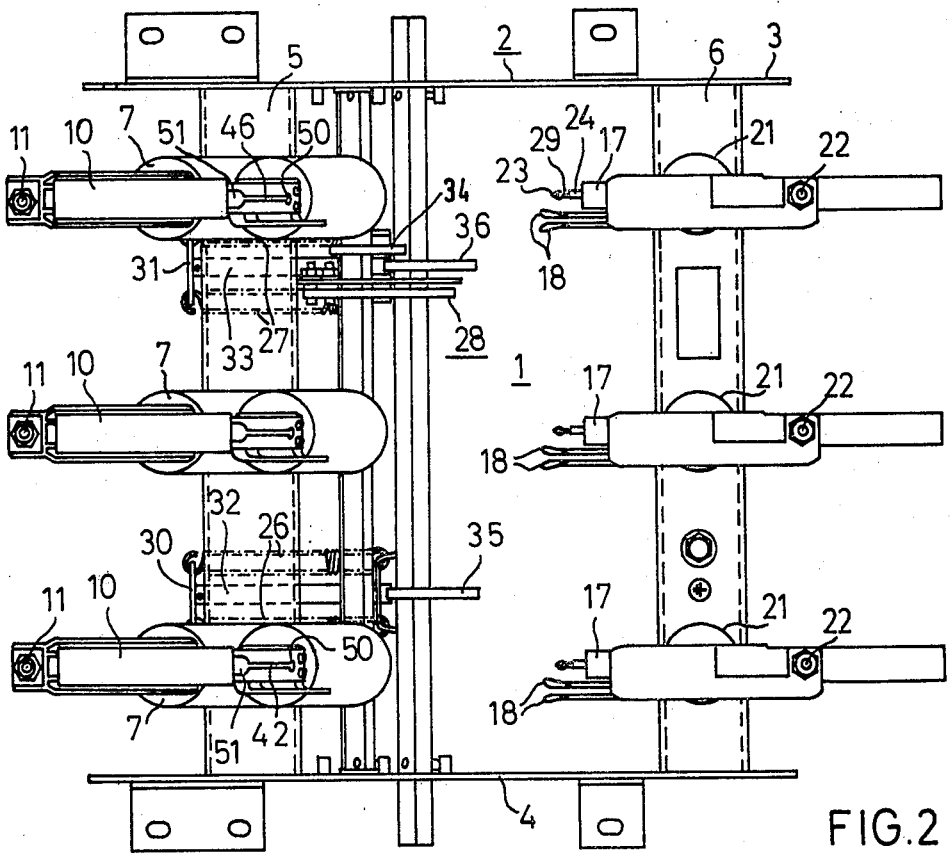
FIG. 2 is a top plan view of the break switch of FIG. 1.

The break switch shown in FIGS. 1 and 2 is intended for use at medium operating voltages. It has a frame 2 which comprises two side members 3 and 4, as well as two cross members 5 and 6 connecting the side members. Three insulator posts 7 are secured side-by-side atop the cross member 5. Each of the posts 7 carries a current lead terminal 11 which simultaneously serves as a support for a flexible current lead 10. The current lead 10 establishes in each current path the connection of the terminal 11 with the switching arm 12 which consists of an insulator post 13 and a contact device positioned atop the post 13. The contact device comprises a blade contact element 14 and a current-carrying driver 15.

The insulator posts 13 of the three adjacent current paths are secured to a switch shaft 16 which is rotatably mounted between the side members 3 and 4 of the frame 2. Each current path further includes a stationary contact member formed by elastic contact laminae 18, as well as a quenching means 17 which, together with the contact laminae 18, is arranged on a support 20. The quenching means 17 is a unit able to function independently, with a switch pin 24 across which the current flows until it is cut off in the interior of the quenching means. The quenching means may be designed as described in the commonly-owned, copending German Pat. App'n. No. P31 11 790.2 filed Mar. 20, 1981 and entitled "Lasttrennschalter mit Trennkontakten und mit einer Loescheinrichtung" ("Load Break Switch with Break Contacts and with a Quenching Means"). A copy of said German application is attached hereto as an Appendix hereof. The support 20 is installed on an insulator post 21 which is secured on the cross member 6 of the frame 2. The support 20 also carries a current lead terminal 22.

Starting in its open switch position as shown in FIG. 1, the break switch 1 is closed by rotating the switch arm 12 clockwise by means of the switch shaft 16. This brings the blade contact element 14 between the contact laminae 18, on the one hand; and, on the other hand, brings the driver 15 into engagement with a ratchet head 23 located at the outer end of the switch pin 24 of the quenching means 17.

The switch shaft 16 is rotated by means of an actuating shaft 25. The shaft 25 is moveably mounted like the shaft 16 between the side members 3 and 4 of the frame 2 and operates in conjunction with a set of closing springs 26 and opening springs 27, as well as a pawl arrangement 28 (see FIG. 2).

The springs 26 and 27 are respectively hooked at their one ends into cross pieces 30 and 31 and are tensioned by guide rods 32 and 33 which are displaceably mounted in openings in the cross member 5. The opposite ends of the closing springs 26 engage at a crank arm mounted on the switch shaft 16, while the opposite ends of the opening springs 27 can act on a drive lever 34 mounted on the switch shaft 16 through a drive pin mounted in the guide rod 33. Tensioning levers 35 and 36 of the actuating shaft 25 permit the simultaneous tensioning of the springs 26 and 27. Further details of the drive mechanism are described in the commonly-owned, copending U.S. Pat. App'n. Ser. No. 358,276 of Kueenzle, et al., entitled "Improved Load Break Switch Drive Mechanism", filed simultaneously herewith.

As can be seen in particular from FIG. 1, during closing and opening of the break switch 1, the switching arm 12 executes a swivel movement during which the blade contact element 14 and the driver 15 move along the arc 40 shown in FIG. 1. By contrast, the switch pin 24 of the quenching means 17 is movable in a straight line along the line 41 shown in FIG. 1. The driver 15 is designed so that it permits displacement of the switch pin 24 or respectively of its ratchet head 23 relative to the switching arm 12. To this end, the driver 15 is arranged on the insulator post 13 and is dimensioned in such a way that the arc 40 and the straight line 41 pass through it at every point of the pivot path of the switching arm 12.

Figure 3:
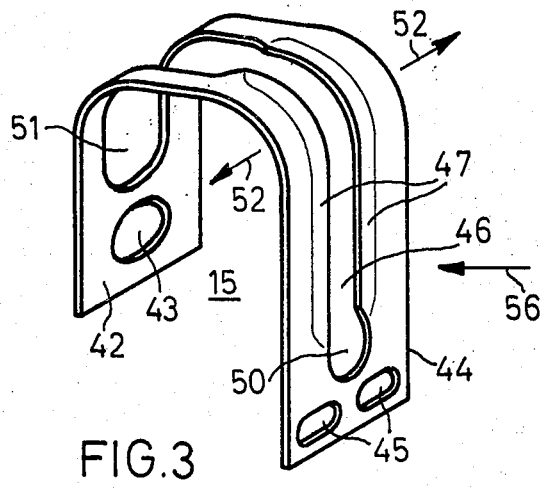
FIG. 3 is an enlarged overall perspective view of the driver of the break switch of FIG. 1.

FIG. 3 shows the details of the driver 15. The driver 15 has the form of an approximately U-shaped yoke whose legs are of unequal length. It is made of conductive material, and to achieve the desired strength it may be made, for example, of sheet steel. The shorter leg 42 of the driver 15 is provided with an opening 43 for connection with the current lead 10. The longer leg 44 is provided with two openings 45 to attach it to the post 13. As shown in FIG. 3, a slot 46 extends over substantially the entire remaining length of the driver 15. The slot 46 is bordered by inwardly inclined flanks 47. The width of the slot 46 corresponds to the diameter of a neck 29 contiguous to the ratchet head 23 of the switch pin 24. Near the end of the longer leg 44 of the driver 15, the slot 46 is provided with an expansion 50 whose diameter is adapted to the ratchet head 23. At the opposite end of the driver 15, i.e. in the region of the shorter leg 42, slot 46 terminates in an enlarged opening 51. The size and shape of the opening 51 affects the reduction in the cross-section of the driver 15 and thereby defines the elastic force against which the slot 46 can be expanded in the direction of the arrows 52 in FIG. 3.

As already mentioned, upon closing the break switch 1 (i.e. for clockwise movement of the switching arm 12 shown in FIG. 1), the driver 15 comes into engagement with the ratchet head 23 of the switch pin 24 of the quenching means 17. The place where the ratchet head 23 strikes the driver 15, as seen in FIG. 1, is the point of the left-hand arrowhead of the arc 40. This corresponds approximately to the region between the tails of the arrows 52 in FIG. 3.

Due to the impingement, the ratchet head 23 passes through the slot 46 with elastic expansion of the driver 15. The inwardly inclined flanks 47 guide the ratchet head toward the center of the slot 46 and facilitate the sliding process during passage.

During the opening of the switch 1 (i.e. counterclockwise movement of the switching arm 12), the driver 15 takes over the current conduction as soon as the blade contact element 14 is separated from the contact laminae 18. The current then flows via the current lead 10, driver 15, switch pin 24 and through contact pieces located in the interior of the quenching means to the terminal device 22. During further rotation of the switching arm 12, the ratchet head 23 slides along in the slot 46 in the direction of the expansion 50. As soon as the latter has been reached (i.e., at the latest in the completely open position shown in FIG. 1), the ratchet head 23 passes through the expansion 50 and returns under the action of a return spring located in the quenching means 17 to its starting position as shown in FIG. 1 and 2.

The driver 15 shown in FIG. 3 is of a sheet steel construction. As can be appreciated by those skilled in the art to which the invention relates, however, the same functions (namely, the lateral embracing of a ratchet head, a spring system for ratchet engagement or coupling, and a defined exit point for uncoupling) can also be achieved using other configurations for the driver 15. For example, the driver 15 can be bent from spring wire of flat or round profile.

Figure 4:
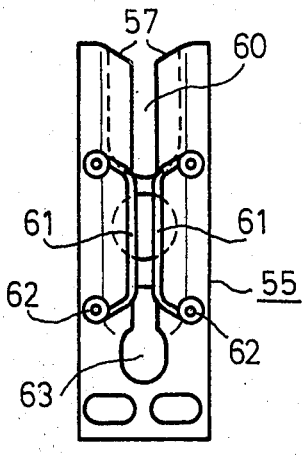
FIG. 4 is a front plan view of a modified form of the driver of FIG. 3.

FIG. 4 shows a driver 55 which is a modified form of the driver 15 of FIG. 3. The driver 55 is shown in a view corresponding approximately to the vantage point indicated by the direction of the arrow 56 in FIG. 3. A funnel-type profile is formed by inclined flanks 57 on both sides of a slot 60. Unlike the driver 15 of FIG. 3, however, the driver 55 of FIG. 4 is configured with two spring-like contact elements 61 arranged symetrically. The elements 61 lie snugly on the driver 55 and serve to improve contact with the ratchet head 23 or respectively with the contiguous neck 29.

The contact elements 61 may be made of spring wire or strip and are fastened to the driver 55 by any suitable fastening means, such as by means of rivets 62. The contact elements 61 need not extend over the entire distance to be traveled by the ratchet head 23 in the slot 60. It suffices if the contact elements 61 begin below the entrance point of the ratchet head on closing and end above the expansion 63, as shown in FIG. 4.

As can be seen from the above description, a driver formed in accordance with the principles of the invention makes it possible to use conventional quenching means having lineally movable switch pins for current-quenching operations in load break switches of the "swivel post" type. The switching arm of each current path can be constructed very simply, since it must only carry a blade contact element and a driver of the inventive type, and need no longer carry any part of the components of the quenching means. The invention thus makes it possible to combine the advantages of "swivel post" insulator switches and thrust blade switches.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto. It will be appreciated that the selection, connection and layout of the various components of the described configurations may be varied to suit individual tastes and requirements.

What is claimed is:

1. In a load break switch of the "swivel post" type, having a fixed electrical contact carried on a stationary post and a movable electrical contact carried on a pivotal switching arm mounted on a switch shaft, and further having a current quenching means to cut off the load current when the switching arm swings into the open switch position, the improvement comprising the quenching means being arranged fixedly as a unit adjacent the fixed contact and including a switch pin mounted for rectilinear displacement and having a ratchet head at its outer end; and the switching arm including a sliding block type driver to which the ratchet head of the switch pin is coupled or uncoupled in dependence on the angular position of the switching arm.

2. An improvement as defined in claim 1, wherein the driver is formed with an elastically expandable slot for guiding the ratchet head, the slot having an expansion at its end closest to the fixed contact when the switch is in an open switch position which permits the passage of the ratchet head through the slot.

3. An improvement as defined in claim 2, wherein the driver is further formed with an enlarged opening at the opposite end of the slot from the expansion, which reduces the cross-section of the driver.

4. An improvement as defined in claim 2, wherein the slot is bordered by inclined flanks.

5. An improvement as defined in claim 2, further comprising at least one spring contact element arranged approximately parallel to the slot at an area of the driver that comes into contact with the ratchet head during switch actuation.

* * * * *